US010104944B2

(12) United States Patent
Dholakiya

(10) Patent No.: US 10,104,944 B2
(45) Date of Patent: Oct. 23, 2018

(54) UNI-DIRECTIONAL MOVEMENT PENDANT

(71) Applicant: Hasmukh Dholakiya, North Bergen, NJ (US)

(72) Inventor: Hasmukh Dholakiya, North Bergen, NJ (US)

( * ) Notice: Subject to any disclaimer, the term of this patent is extended or adjusted under 35 U.S.C. 154(b) by 254 days.

(21) Appl. No.: 15/015,334

(22) Filed: Feb. 4, 2016

(65) Prior Publication Data

US 2017/0224069 A1 Aug. 10, 2017

(51) Int. Cl.

| | |
|---|---|
| ***A44C 25/00*** | (2006.01) |
| ***A44C 5/00*** | (2006.01) |
| ***A44C 13/00*** | (2006.01) |
| ***A44C 17/02*** | (2006.01) |

(52) U.S. Cl.

CPC ..... *A44C 25/001* (2013.01); *A44C 17/025* (2013.01)

(58) Field of Classification Search

CPC . A44C 17/02; A44C 17/0208; A44C 17/0241; A44C 17/025; A44C 17/00; A44C 25/001; A44C 25/007; A44C 7/002; A44C 5/00; A44C 11/002; G09F 2023/0016

USPC .... 63/28, 29.1, 30, 31, 40, 26, 21, 13, 14.1, 63/38, 33, 23; 40/618

See application file for complete search history.

(56) References Cited

U.S. PATENT DOCUMENTS 397,833 A * 2/1889 Colby ..... A44C 5/0092 224/221
466,344 A * 1/1892 Groenman ..... A44C 1/00 24/163 K
1,371,932 A * 3/1921 Przybyla ..... A44C 11/00 24/115 H
1,973,616 A * 9/1934 Fleeman ..... G09F 7/10 40/618
2,205,918 A * 6/1940 Bangs ..... A44C 15/004 29/513
2,653,402 A * 9/1953 Bonagura ..... A44C 9/00 40/618
D255,785 S * 7/1980 Bishton ..... 63/31
4,305,262 A * 12/1981 Ferrara ..... A44C 5/00 63/29.1
4,430,869 A * 2/1984 Zinni ..... A44C 25/001 40/618
4,879,882 A * 11/1989 Johnson ..... A44C 15/004 63/13

(Continued)

*Primary Examiner* — Jack W Lavinder

(74) *Attorney, Agent, or Firm* — Jennifer Meredith, Esq.; Meredith & Keyhani, PLLC

(57) ABSTRACT

A pendant comprising: an anchor portion having a top flat portion, bottom flat portion and connector between and substantially perpendicular to the top flat portion and the bottom flat portion with a first end and a second end; at least one gemstone holder having a first side portion with a first protrusion and a second side portion with a second protrusion, an opening between the first side portion and the second side portion, a top portion in communication with the first side portion and the second side portion, wherein the anchor portion is received in the opening of each of the at least one gemstone holders to allow the gemstone holders to slide along the anchor portion; a first end rectangular support that is attached to a first end of the anchor portion; and a second end rectangular support that is attached to a second end of the anchor portion.

11 Claims, 14 Drawing Sheets

(56) References Cited

U.S. PATENT DOCUMENTS

| | | | | |
|---|---|---|---|---|
| 5,896,757 | A * | 4/1999 | Kharloubian | A44C 17/025 63/28 |
| 2009/0038338 | A1* | 2/2009 | Korwin | A44C 7/002 63/1.11 |
| 2013/0239610 | A1* | 9/2013 | Lim | A44C 13/00 63/12 |

* cited by examiner

UNI-DIRECTIONAL MOVEMENT PENDANT

BACKGROUND OF THE INVENTION

1—Priority Claim and Field of the Invention

The present invention relates generally to jewelry and a pendant that allows for gemstones to lay flat, with some movement, yet not allowing for removal or flipping of the stone. It also may accommodate customization and incremental addition of gemstones at the time of assembly.

2—Description of Related Art

Prior art pendants generally hang from a chain and may turn or fall off. They are generally attached by a jump ring, which frequently open and may result in the loss of expensive gemstones. Still further, they turn and the bottom of the gemstone may be seen, as opposed to the top with the gemstone. Pstill further, it may be desirable to customize the color of gemstones, or move them around. For example, one user may want an emerald on either side of a diamond. Another wearer may want two diamonds on either side of a single emerald. The present invention allows for easy customization at the time of assembly.

SUMMARY OF THE INVENTION

Aspects of the present invention provide a pendant apparatus that includes gemstones and is easily customizable.

One aspect of the present invention provides, a pendant comprising: an anchor portion having a top flat portion, bottom flat portion and connector between and substantially perpendicular to the top flat portion and the bottom flat portion, wherein the anchor portion has a first end and a second end; at least one gemstone holder having a first side portion with a first protrusion and a second side portion with a second protrusion, an opening between the first side portion and the second side portion, and a top portion in communication with the first side portion and the second side portion, wherein the anchor portion is received in the opening of each of the at least one gemstone holders to allow the gemstone holders to slide along the anchor portion; a first end rectangular support that is attached to a first end of the anchor portion; and a second end rectangular support that is attached to a second end of the anchor portion.

DETAILED DESCRIPTION OF THE INVENTION

The pendant of the present invention, improves upon the experience of wearing jewelry by allowing the wearer to have a range of gemstones that may vary in size, color and shape and a pendant that accommodates such changes while ensuring secure retaining of the gemstones in an upright position. The gemstones move in a single unitary direction along the anchor portion. In this way, the movement of the gemstone holder is uni-directional.

FIGS. 1-27 depict various pendants according to the present invention. The term pendant includes necklaces and bracelets.

Figure 1:
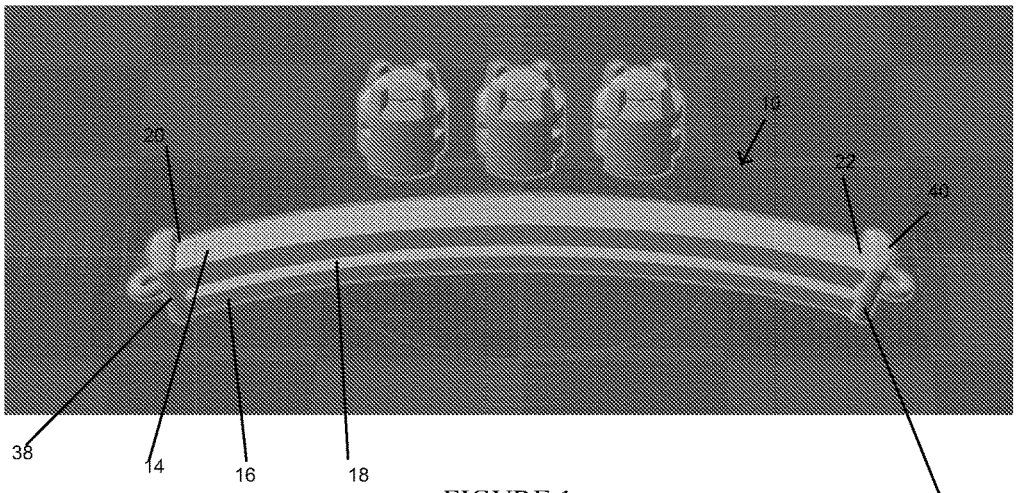
FIG. 1 is a top perspective view of the pendant as in the present invention.
Figure 2:
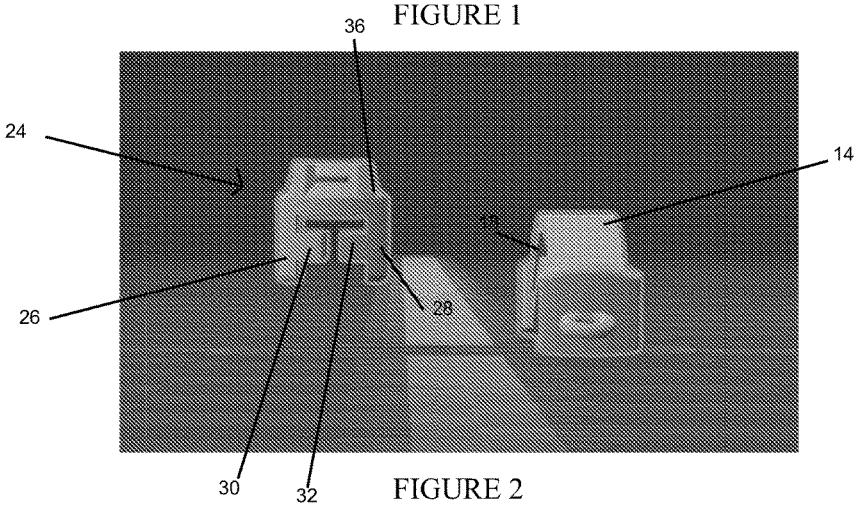
FIG. 2 is a front view of the pendant as in the present invention.
Figure 3:
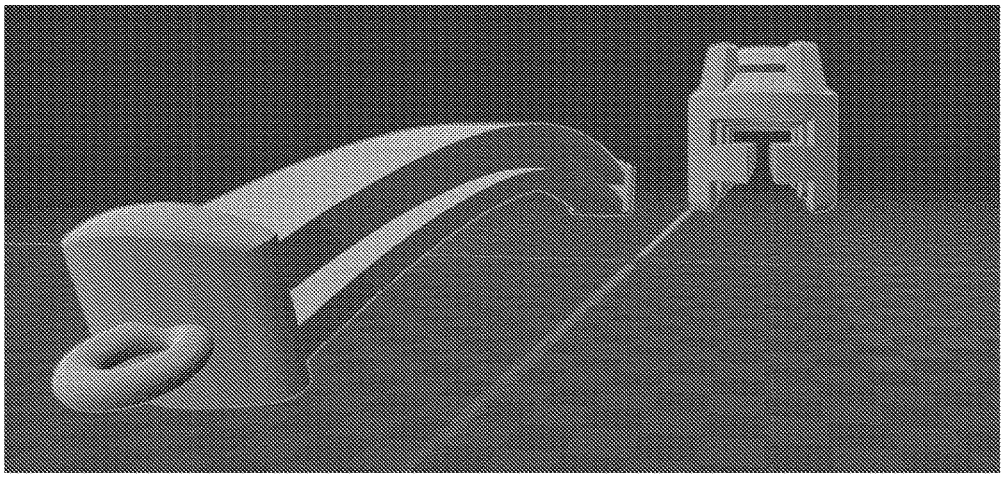
FIG. 3 is a side perspective view of the pendant as in the present invention.
Figure 4:
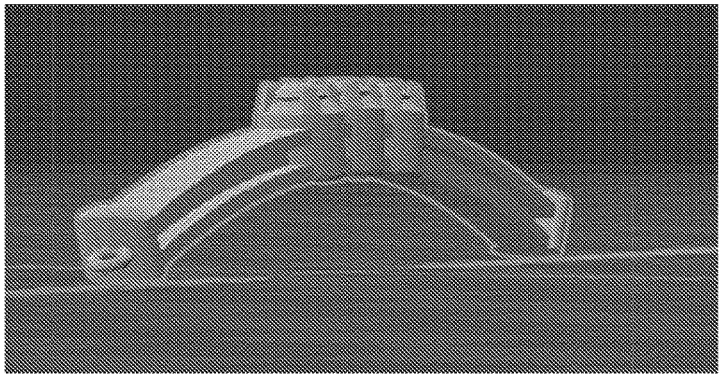
FIG. 4 is a side perspective view of the pendant as in the present invention.

As shown in FIGS. 1 and 2, there is a pendant (10) comprising: an anchor portion (12) having a top flat portion (14), bottom flat portion (16) and connector (18) between and substantially perpendicular to the top flat portion (14) and the bottom flat portion (16). One of, or both of, the top flat portion and the bottom flat portion may be solid. The anchor portion has a first end (20) and a second end (22). It should be noted the top flat portion is substantially flat. It may have rounded portions without departing from the present invention. Similarly, the bottom flat portion is substantially flat. The top flat portion, the bottom flat portion and the connector between and substantially perpendicular to the top flat portion and the bottom flat portion form an I-beam shaped cross section. This may also be described as a H-shaped cross section (depending on how you view the orientation) having a top flange shape (top flat portion 14) and a bottom flange shape (bottom flat portion 16) with a web therebetween (connector 18) and substantially perpendicular to the top flange shape (top flat portion 14) and bottom flange shape (bottom flat portion 16).

There may be at least one gemstone holder (24) having a first side portion (26) with a first protrusion (30) and a second side portion (28) with a second protrusion (32), an opening (34) between the first side portion (26) and the second side portion (28). The opening between the first side portion and the second side portion may be an I-beam shaped opening. This may also be described as a H-shaped opening, having a top flange shape and a bottom flange shape with a web therebetween and substantially perpendicular to the top flange shape and bottom flange shape. A top portion (36) is in communication with the first side portion (26) and the second side portion (28), the anchor portion (12) is received in the opening (34) of each of the at least one gemstone holders to allow the gemstone holders to slide along the anchor portion (12). A first end rectangular support (38) is attached to a first end (20) of the anchor portion (12) and a second end rectangular support (40) is attached to a second end (22) of the anchor portion (12).

Figure 5:
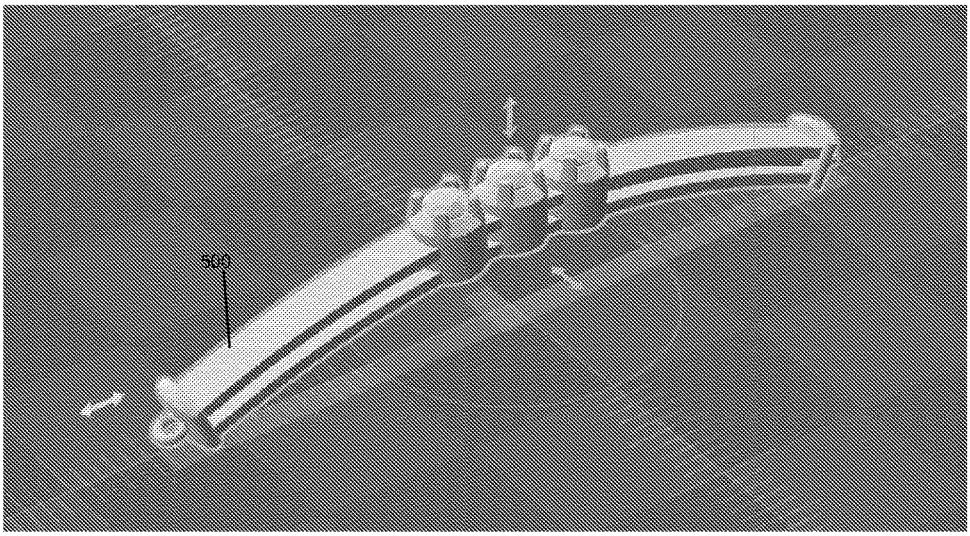
FIG. 5 is a top perspective view of a bracelet pendant shape according to the present invention.
Figure 6:
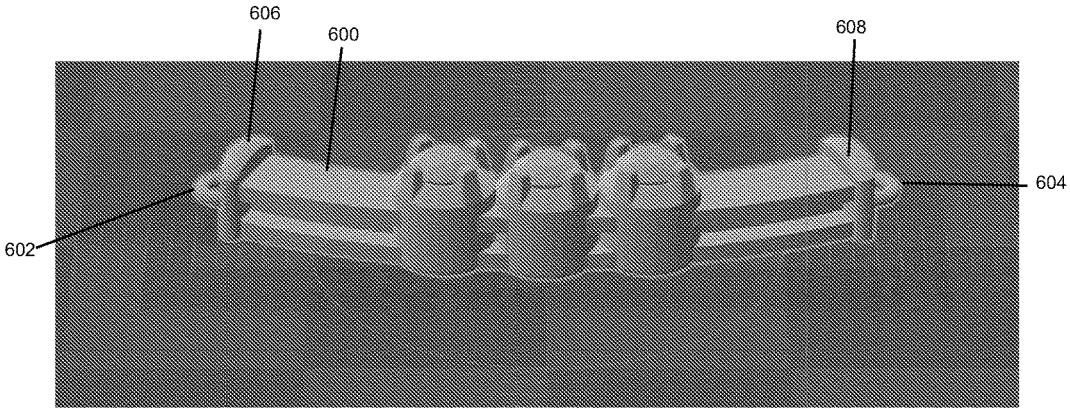
FIG. 6 is a top perspective view of a necklace pendant shape according to the present invention.

As shown in FIGS. 5 and 6, the anchor portion (500 and 600) is bent to form a curved pendant. There may be a first rounded opening (602) attached to the first end rectangular support (606) and a second rounded opening (604) attached to the second end rectangular support (608). FIG. 5 depicts the anchor portion is curved upward between the first end and the second end perpendicular to the connector to form a bracelet pendant. The curve would follow the manner in which it would sit on the wrist of a wearer. FIG. 6 depicts the anchor portion is curved downward between the first end and the second end and parallel to the connector to form a necklace pendant.

Figure 26:
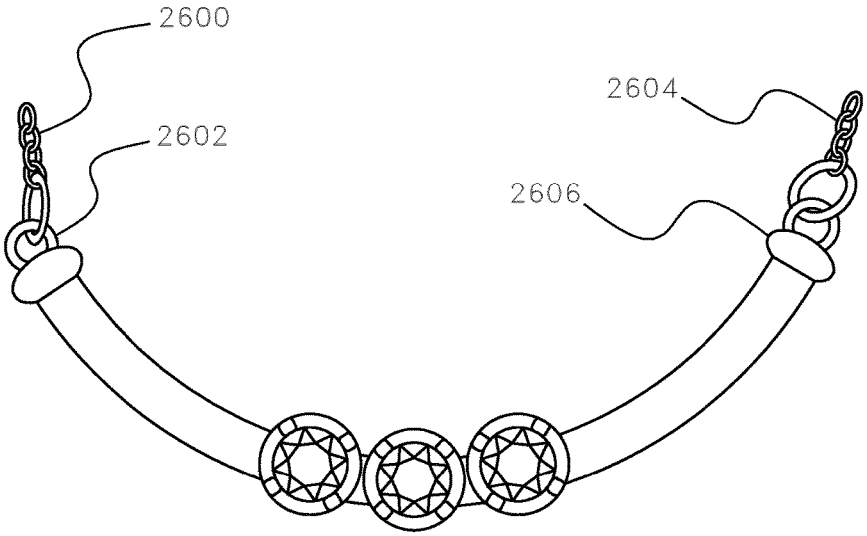
FIG. 26 is a top view of a necklace pendant according to the present invention.
Figure 27:
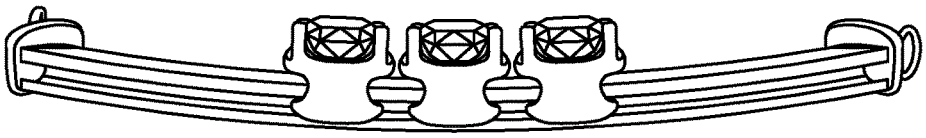
FIG. 27 is a side view of a necklace pendant according to the present invention.

As shown in FIGS. 26-27, there may be a first half of a necklace (2600) attached to the first rounded opening (2602) and a second half of the necklace (2604) attached to the second rounded opening (2606). The first half of the necklace removably attaches to the second half of the necklace. For example, there may be a clasp at the other end of the first half and second half of the necklace that clasps together around the neck of the wearer. There may also be a necklace chain having a first necklace end and a second necklace end, wherein the first necklace end is attached to the first rounded opening and the second necklace end is attached to the second rounded opening. In this case it is a single chain attached and it therefore must be large enough to fit over the head of the wearer, as it would not clasp.

Figure 25:
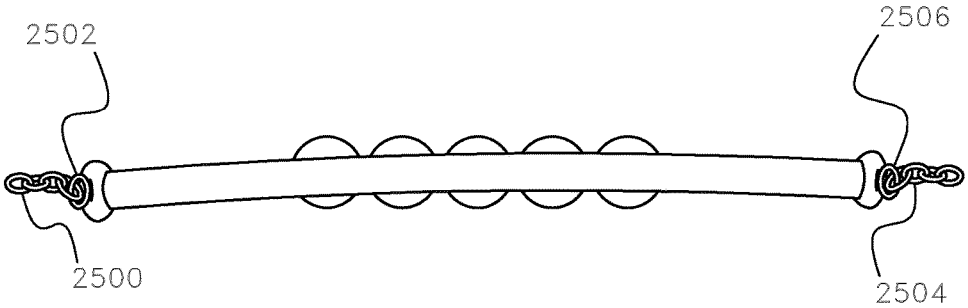
FIG. 25 is a bottom view of a bracelet pendant according to the present invention.

FIG. 25 depicts, a first half of a bracelet (2500) attached to the first rounded opening (2502) and a second half of a bracelet (2504) attached to the second rounded opening (2506). The first half of the bracelet (2500) removably attaches to the second half of the bracelet (2504). As with the necklace this may be by way of a clasp.

The gemstone holder (24) may be a variety of shapes, as depicted in FIGS. 9-20, such as a square gemstone holder (1000), a round gemstone holder (1100), an oval gemstone holder (1200), a heart shaped gemstone holder (1300), a quatrefoil shaped gemstone holder (1400), a pentagon shaped gemstone holder (1500), a hexagon shaped gemstone holder (1600), a heptagon shaped gemstone holder, an octagon shaped gemstone holder, a nonagon shaped gemstone holder, a decagon shaped gemstone holder, a triangular shaped gemstone holder (1700), a crescent shaped gemstone holder (1800), an ellipse shaped gemstone holder, a trapezoid shaped gemstone holder (1900), a kite shaped gemstone holder (2000), a rhombus shaped gemstone holder and star shaped gemstone holder (2100). The dotted lines in each of the FIGS. 9-20 depict the approximate location of the opening. The mated I-beam shapes of the opening and the anchor portion allows the gemstone holder to be secure and does not rotate. The gemstone will slide along the anchor portion, but will not turn. A heart, for example, will appear with the gemstone side up at all times, unlike a traditional pendant which can turn.

Figure 21:
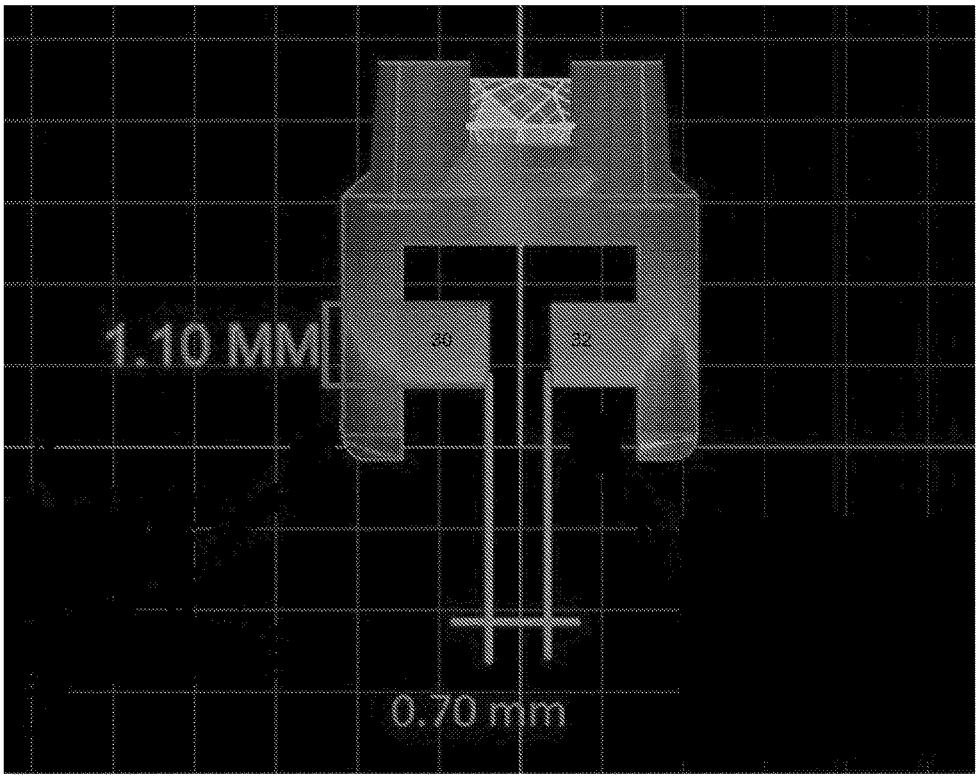
FIG. 21 is a side view of the gemstone holder according to the present invention.
Figure 22:
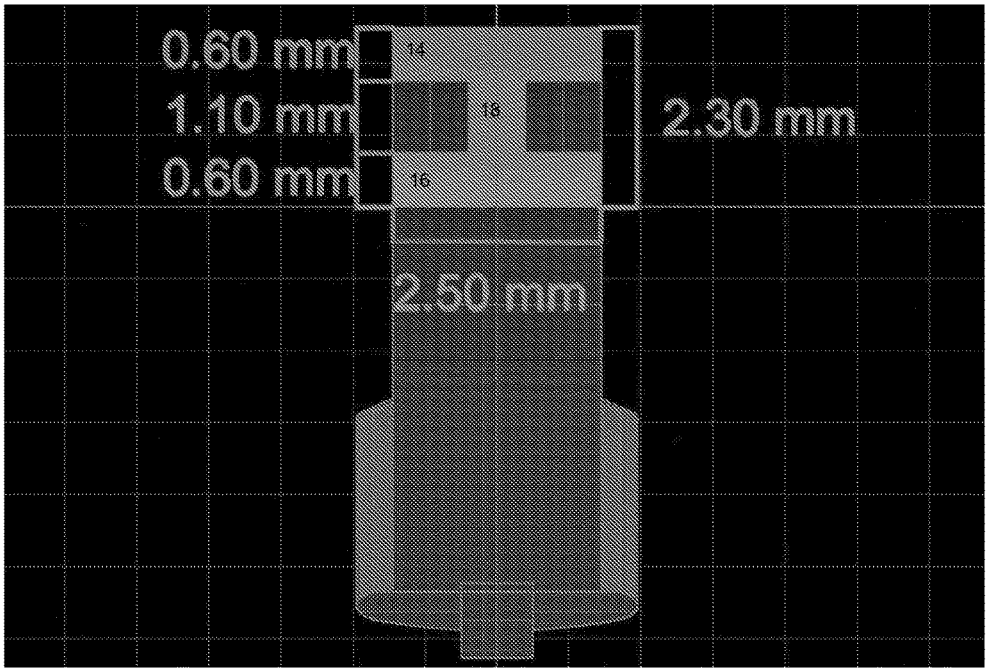
FIG. 22 is a side view of the anchor portion of a bracelet pendant according to the present invention.
Figure 23:
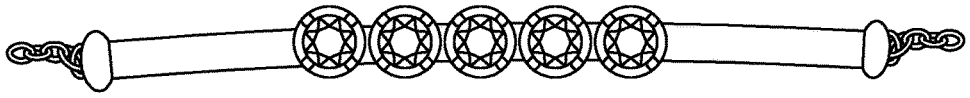
FIG. 23 is a top view of the pendant according to the present invention.
Figure 24:
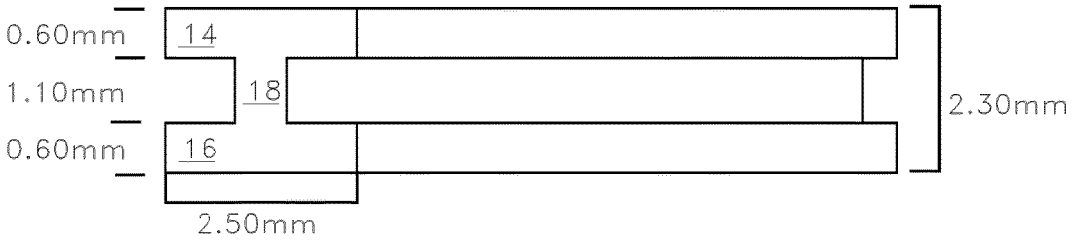
FIG. 24 is a side cut away view of a bracelet pendant according to the present invention.

FIGS. 21-27 depict the manner in which the gemstone holders are attached to the anchor portion. As can be seen, the gemstone holder would be loaded onto the anchor portion with the opening of the gemstone holder sliding onto the I-beam cross section of the anchor portion. As would appreciated by one of ordinary skill in the art, at least one of the first end rectangular support and/or the second end rectangular support would have to removed for the gemstone holder to be loaded onto the anchor portion. Once loaded, the first end rectangular support and the second end rectangular support would be attached, for example by soldering, to close off the mounted gemstone holders. FIG. 21 depicts an example of dimensions. The height of the first protrusion (30) and second protrusion (32) is 1.10 mm. The width between the first protrusion (30) and the second protrusion (32) is 0.70 mm. The I-shape cross section of the anchor portion (12) is shown in FIG. 22 with the top flat portion (14) having a height of 0.60 mm, the bottom flat portion (16) having a height of 0.60 mm and the connector (18) having a height of 1.10 mm. The width of the anchor portion is 2.5 mm. FIG. 22 depicts the bracelet version of the pendant. In this was the I-shaped opening of the gemstone holder is loaded onto the I-shaped cross section of the anchor portion, as shown in FIG. 23. FIGS. 24 and 26 depicts a necklace version. As will be appreciated the curve is in a different direction for a necklace than a bracelet. The top portion of the gemstone holder is above the top flat portion (14) of the anchor portion (12).

Figure 7:
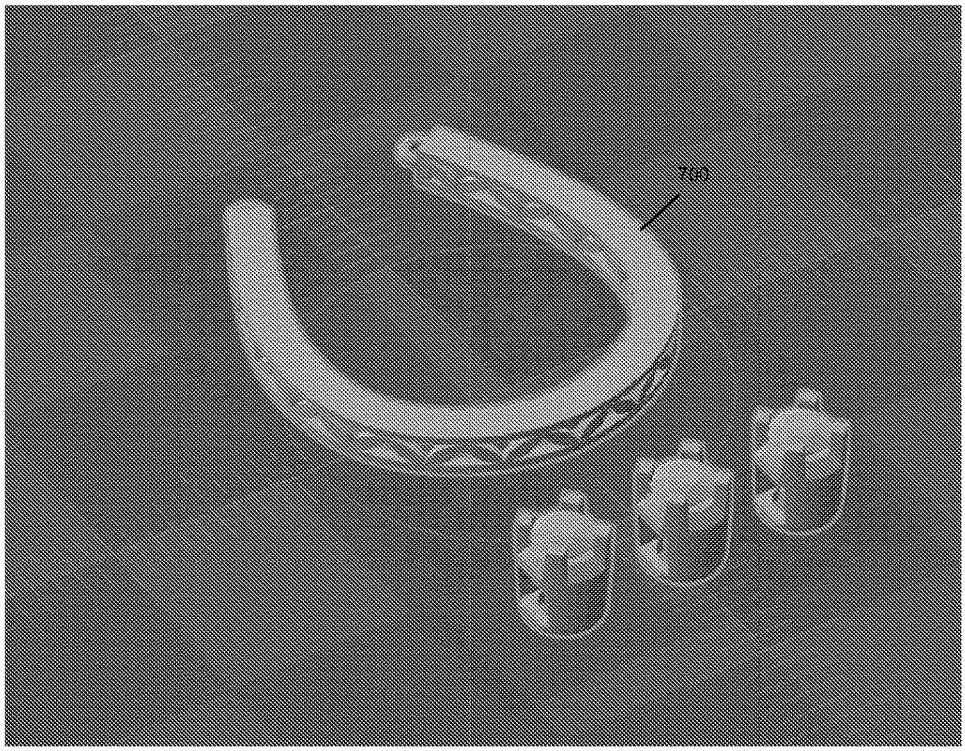
FIG. 7 is a horseshoe shape of a pendant according to the present invention.
Figure 8:
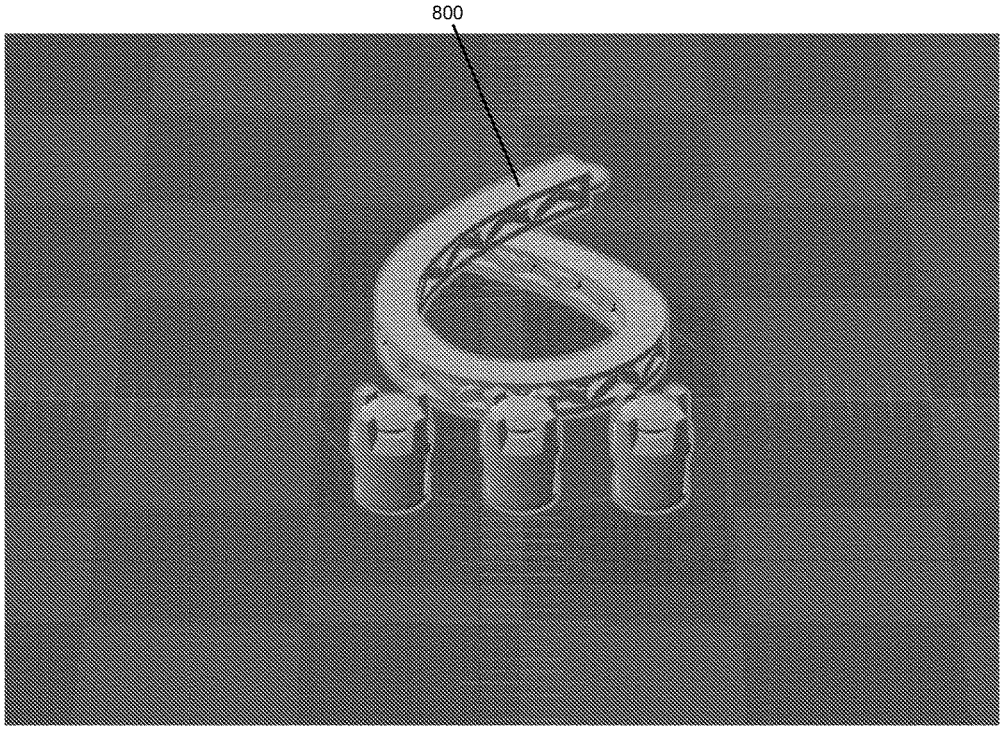
FIG. 8 is an over-under shape of a pendant according to the present invention.
Figure 9:
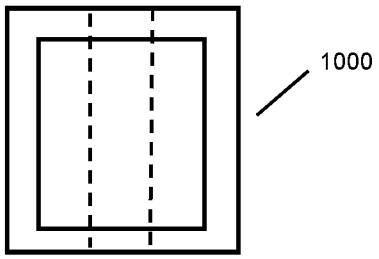
FIGS. 9-20 depict different shapes the gemstone holder may be.
Figure 10:
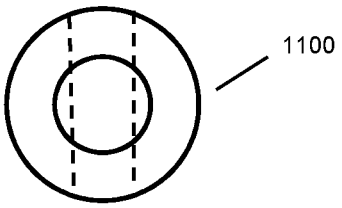
Figure 11:
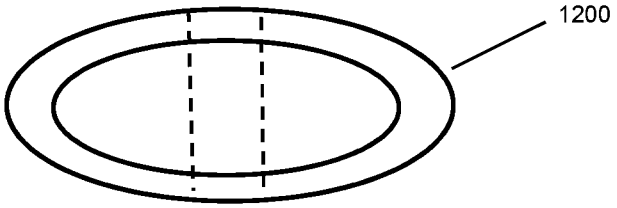
Figure 12:
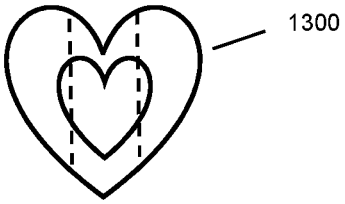
Figure 13:
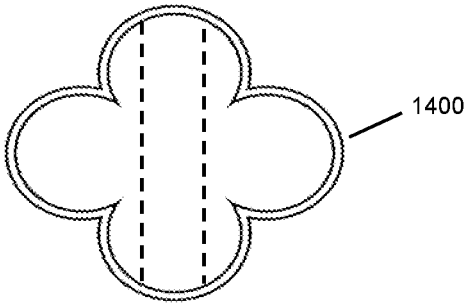
Figure 14:
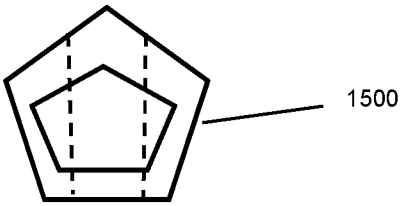
Figure 15:
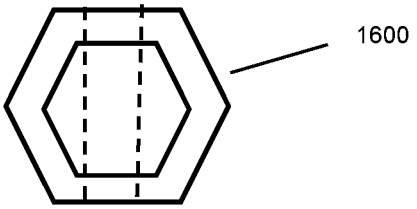
Figure 16:
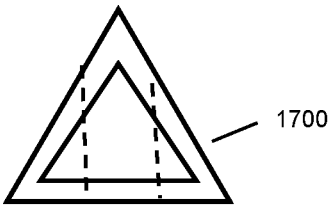
Figure 17:
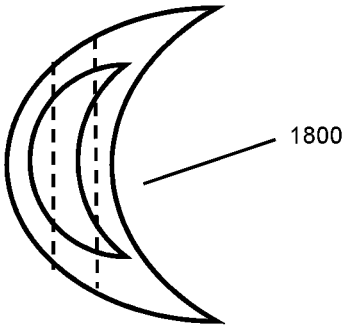
Figure 18:
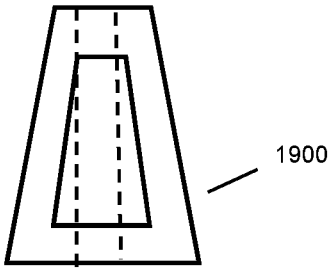
Figure 19:
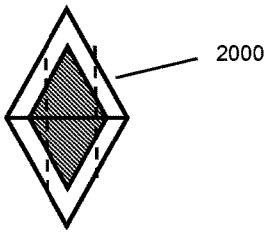
Figure 20:
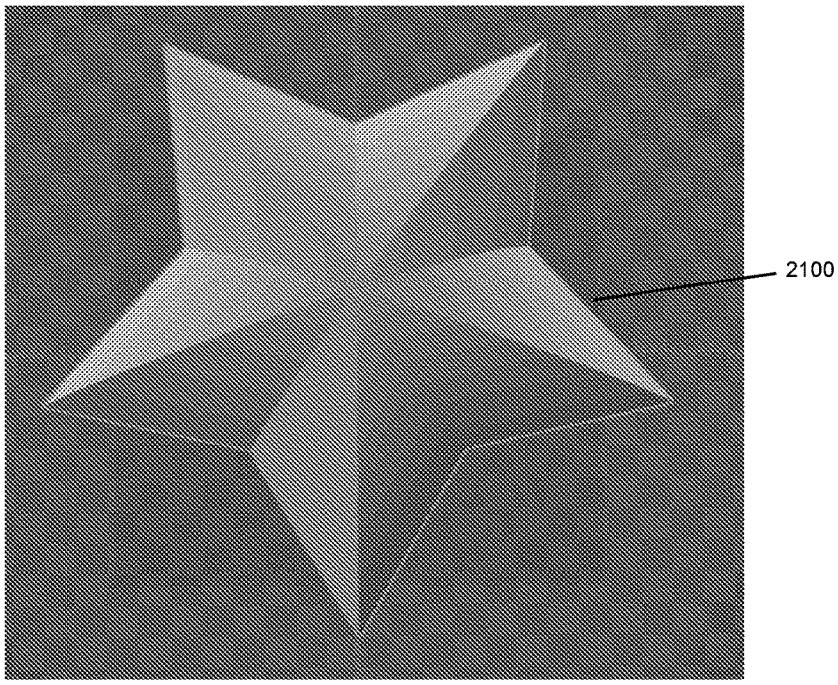

As shown in FIGS. 7-8, the anchor portion may be bent into a horseshoe shape (700), a smiley shape (similar to the horseshoe shape with a smaller angle), an over-under shape (800) and a bracelet bar shape (as shown in FIG. 5. Note that FIGS. 7 and 8 are intended to show different shapes of the anchor portion and do not depict the I-beam cross section.

The present invention has been described in relation to particular examples, which are intended to be illustrative rather than restrictive, with the scope and spirit of the invention being indicated by the following claims and their equivalents.

What is claimed is:

1. A pendant comprising:

an anchor portion having a top flat portion, bottom flat portion and connector between and substantially perpendicular to the top flat portion and the bottom flat portion, wherein the anchor portion has a first end and a second end;

at least one gemstone holder having a first side portion with a first protrusion and a second side portion with a second protrusion, an opening between the first side portion and the second side portion and a top portion in communication with the first side portion and the second side portion, wherein the anchor portion is received in the opening of each of the at least one gemstone holders to allow the gemstone holders to slide along the anchor portion, wherein the opening is an I-beam shaped opening;

a first end rectangular support that is attached to a first end of the anchor portion; and a second end rectangular support that is attached to a second end of the anchor portion wherein the top flat portion, the bottom flat portion and the connector between and substantially perpendicular to the top flat portion and the bottom flat portion form an I-beam shaped cross section, wherein the I-beam shaped cross section is a mated shape with the I-beam shaped opening to provide each of the gemstone holders secure and not rotating.

2. A pendant in claim 1, wherein the gemstone holder is selected from the group consisting of a square gemstone holder, a cushion gemstone holder, a pear shaped gemstone holder, a round gemstone holder, an oval gemstone holder, a heart shaped gemstone holder, quatrefoil shaped gemstone holder, a pentagon shaped gemstone holder, a hexagon shaped gemstone holder, a heptagon shaped gemstone holder, an octagon shaped gemstone holder, a nonagon shaped gemstone holder, a decagon shaped gemstone holder, a triangular shaped gemstone holder, a crescent shaped gemstone holder, an ellipse shaped gemstone holder, a trapezoid shaped gemstone holder, a kite shaped gemstone holder and a rhombus shaped gemstone holder.

3. A pendant as in claim 1, wherein the anchor portion is bent to form a curved pendant.

4. A pendant as in claim 1, further comprising a first rounded opening attached to the first end rectangular support and a second rounded opening attached to the second end rectangular support.

5. A pendant as in claim 4, further comprising a first half of a necklace attached to the first rounded opening and a second half of the necklace attached to the second rounded opening, wherein the first half of the necklace removably attaches to the second half of the necklace.

6. A pending as in claim 4, further comprising a first half of a bracelet attached to the first rounded opening and a second half of a bracelet attached to the second rounded opening, wherein the first half of the bracelet removably attaches to the second half of the bracelet.

7. A pendant as in claim 1, further comprising a necklace chain having a first necklace end and a second necklace end, wherein the first necklace end is attached to the first rounded opening and the second necklace end is attached to the second rounded opening.

8. A pendant as in claim 1, wherein the anchor portion is curved downward between the first end and the second end and parallel to the connector to form a necklace pendant.

9. A pendant as in claim 1, wherein the anchor portion is curved upward between the first end and the second end perpendicular to the connector to form a bracelet pendant.

10. A pendant as in claim 1, wherein one of the top flat portion and the bottom flat portion is solid.

11. A pendant as in claim 1, wherein the anchor portion is bent into a shape selected from the group consisting of a horseshoe shape, a smiley shape, an over-under shape and a bracelet bar shape.

* * * * *